US010220639B2

(12) United States Patent
Hashizume

(10) Patent No.: US 10,220,639 B2
(45) Date of Patent: Mar. 5, 2019

(54) PRINTER, PRINTING METHOD, AND INK

(71) Applicant: MIMAKI ENGINEERING CO., LTD., Nagano (JP)

(72) Inventor: Hironori Hashizume, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 15/544,521

(22) PCT Filed: Jan. 19, 2016

(86) PCT No.: PCT/JP2016/051422
§ 371 (c)(1),
(2) Date: Jul. 19, 2017

(87) PCT Pub. No.: WO2016/117550
PCT Pub. Date: Jul. 28, 2016

(65) Prior Publication Data

US 2018/0009236 A1 Jan. 11, 2018

(30) Foreign Application Priority Data

Jan. 22, 2015 (JP) ..... 2015-010491

(51) Int. Cl.
*B41J 11/00* (2006.01)
*B41J 2/01* (2006.01)
(Continued)

(52) U.S. Cl.
CPC ..... *B41J 11/002* (2013.01); *B41J 2/01* (2013.01); *B41M 5/0011* (2013.01); *B41M 7/0081* (2013.01)

(58) Field of Classification Search
CPC ..... B41J 11/002; B41J 2/01; B41J 2/2107; C09D 11/101; C09D 11/322
See application file for complete search history.

(56) References Cited

U.S. PATENT DOCUMENTS 8,894,197 B2 * 11/2014 Oyanagi ..... C09D 11/101 347/1
9,963,604 B2 * 5/2018 Kikuchi ..... C09D 11/322
(Continued)

FOREIGN PATENT DOCUMENTS

JP 2005-089784 4/2005
JP 2011-246718 12/2011
(Continued)

OTHER PUBLICATIONS

"International Search Report (Form PCT/ISA/210) of PCT/JP2016/051422", dated Mar. 15, 2016, with English translation thereof, pp. 1-3.
(Continued)

*Primary Examiner* — John P Zimmermann
(74) *Attorney, Agent, or Firm* — JCIPRNET

(57) ABSTRACT

Both stability and high glossiness of a glossy ink used for printing can be achieved. A printer is provided that performs inkjet printing for a medium. The printer includes a glossy ink head as an inkjet head that discharges droplets of a glossy ink, a heater, and an ultraviolet light source. The glossy ink includes an ultraviolet-curable resin curable by being irradiated with ultraviolet light, a glossy pigment, and a solvent added to disperse the pigment. Particles of the glossy pigment have particle sizes less than or equal to 0.5 μm. The heater heats the medium to volatilize and strip the solvent in the ink. The ultraviolet light source irradiates dots of the glossy ink on the medium with ultraviolet light after a preset waiting time has passed subsequent to a timing of the droplets of the glossy ink landing on the medium.

5 Claims, 2 Drawing Sheets

(51) Int. Cl.
*B41M 5/00* (2006.01)
*B41M 7/00* (2006.01)

(56) References Cited

U.S. PATENT DOCUMENTS

| | | | | |
|---|---|---|---|---|
| 2012/0174824 | A1* | 7/2012 | Takenaka | B22F 1/0055 106/404 |
| 2012/0212554 | A1* | 8/2012 | Koike | B41M 7/009 347/105 |
| 2012/0287200 | A1* | 11/2012 | Yano | C09D 11/101 347/20 |
| 2013/0029045 | A1* | 1/2013 | Koganehira | C09D 137/00 427/256 |
| 2013/0286069 | A1* | 10/2013 | Aoyama | B41J 2/21 347/9 |

FOREIGN PATENT DOCUMENTS

| | | |
|---|---|---|
| JP | 2012001581 | 1/2012 |
| JP | 2012-245676 | 12/2012 |
| JP | 2013-147544 | 8/2013 |

OTHER PUBLICATIONS

"Office Action of Japan Counterpart Application," dated Sep. 4, 2018, with English translation thereof, pp. 1-11.

* cited by examiner

PRINTER, PRINTING METHOD, AND INK

CROSS-REFERENCE TO RELATED APPLICATION

This application is a 371 application of the International PCT application serial no. PCT/JP2016/051422, filed on Jan. 19, 2016, which claims the priority benefit of Japan application no. JP 2015-010491, filed on Jan. 22, 2015. The entirety of the abovementioned patent applications is hereby incorporated by reference herein and made a part of this specification.

TECHNICAL FIELD

The present invention relates to a printer, a printing method, and an ink.

BACKGROUND ART

Conventionally, inkjet printers configured to perform inkjet printing are extensively used. As known inks used with the inkjet printers, metallic inks having metallic luster are known. Examples of the metallic inks that have been put to practical use are solvent inks containing metallic pigments in the form of scaly particles (Patent Literature 1).

CITATION LIST

Patent Literature

Patent Literature 1: Japanese Unexamined Patent Publication No. 2011-246718

SUMMARY

Technical Problems

In order to have a real metallic texture using a metallic ink, pigment particles contained in the ink should be increased in size (diameter) to a certain or greater extent. On the other hand, the inkjet printing is more likely to undergo, for example, poor ink discharge ability, with pigment particles greater in size. The pigment particles settling out in the ink may cause imbalance in the ink's composition, leading to failure to properly perform the metallic color printing. Large pigment particles, if used in the metallic ink, may considerably compromise the ink's stability in terms of its discharge ability and composition.

In case the pigment particles are reduced in size in favor of the ink's stability, a layer formed with the metallic ink (coating film) usually degrades in brightness, losing a desired metallic texture. When a metallic ink is used for printing, the ink's stability and obtainable metallic texture are thus in trade-off relationship attributed to the pigment particle sizes.

Desirably, the metallic ink's stability in terms of its discharge ability and composition and the real metallic texture should be both achieved in order to more effectively perform the metallic ink printing. To address these issues of the known art, the present invention provides a printer, a printing method, and an ink.

Solutions to the Problems

To this end, the inventor of the present invention conducted researches and studies on the use of glossy inks including metallic inks. First, he conducted studies on the particle sizes of glossy pigments added to glossy inks.

It is required of the inkjet printing to use low-viscosity inks and discharge them through finely structured nozzles. Such finely-structured nozzles may be more easily clogged with pigment particles as they are greater in size, resulting in poor discharge ability. With low viscosity required of inks used, large-sized pigment particles are likely to settle out in the inks.

It is desirable in the inkjet printing to use very small pigment particles. Specifically, a glossy ink, such as a metallic ink, desirably contains a pigment having particle sizes less than or equal to 0.5 μm.

In the known art using a solvent ink as the metallic ink, a solvent contained in the ink is quickly volatilized and stripped shortly after droplets of the ink have landed on a medium so as to fix the ink to the medium. The inventor of this application found out that the ink thus fixed to the medium in short time was often dried with pigment particles being randomly oriented in the ink. He also found out that such random orientation at the time of fixing the ink to the medium was more likely with smaller pigment particles.

The inventor of this application learned through his further studies that high glossiness was attainable if even small pigment particles were oriented (aligned), not randomly, but properly and orderly enough, at the time of fixing the ink to the medium. Specifically, he found that high glossiness may be attainable even with, for example, a pigment having such small particle sizes as 0.5 μm or less if the viscosity of the ink can be kept low enough for a certain period of time or longer after droplets of the ink have landed on the medium, because the pigment particles may be oriented well during the period of time.

In the conventional solvent inks mostly containing volatile organic solvents to disperse pigments in the inks, however, the solvents are volatilized away in short time. These conventional solvent inks can hardly afford adequate time for pigment particles to be oriented well before the inks are dried.

The inks may be more difficult to dry if their solvents are changed, which, however, raises other issues. In case of an ink containing a solvent that takes an extended time to be volatilized, low viscosity of the ink on the medium is sustained for the extended time, which increases the risk of ink bleeding.

To deal with these issues, the inventor of this application, through his further studies, came up with the idea of using a glossy ink fixable to the medium by other means in addition to the solvent-volatilizing means, unlike the solvent inks fixable to the medium by the solvent-volatilizing means alone. The inventor then discussed the idea of using an ink fixable to the medium by two means; heating the medium to volatilize the solvent, and irradiating the ink with ultraviolet light.

After the ink droplets have landed on the medium, by heating the medium to volatilize and strip the solvent in the ink, the ink is increased in viscosity. The ink not irradiated with ultraviolet light at this time point is not fully cured but may be increased in viscosity to an extent that bleeding of the ink on the medium is avoidable.

By thickening the ink to a bleeding-avoidable viscosity, bleeding of the ink may be prevented despite a long-time interval before ultraviolet radiation starts. Thus, plenty of time can be invested for the pigment particles to be oriented orderly enough on the medium before ultraviolet radiation starts, and high glossiness may be attainable even with pigment particles smaller in size. As a result, the ink's stability in terms of its discharge ability and composition and the high glossiness (for example, real metallic texture) may be both successfully achieved. The present invention provides the following technical features to solve the above problem.

[Configuration 1]

A printer is provided that performs inkjet printing for a medium. The printer includes a glossy ink head as an inkjet head that discharges droplets of a glossy ink which is an ink with glossiness, a heater that heats the medium, and an ultraviolet light source that irradiates dots of the glossy ink formed on the medium by the glossy ink head with ultraviolet light. The glossy ink includes: an ultraviolet-curable resin curable by being irradiated with ultraviolet light, a glossy pigment, and a solvent added to disperse the glossy pigment. Particles of the glossy pigment have particle sizes less than or equal to 0.5 μm. The heater heats the medium to volatilize and strip the solvent in the glossy ink. The ultraviolet light source irradiates the dots of the glossy ink on the medium with ultraviolet light after a preset waiting time has passed subsequent to a timing of the droplets of the glossy ink landing on the medium.

This configuration, by adding the pigment having small particle sizes to the glossy ink, may effectively avoid poor ink discharge ability and prevent the pigment from settling out in the glossy ink. Thus, the ink's stability in terms of its discharge ability and composition may be effectively improved.

By having the ink fixed to the medium in two operations that respectively use the heater and the ultraviolet light source, bleeding of the ink on the medium may be unlikely, and the pigment particles in the glossy ink may be oriented properly and orderly enough. Specifically, by volatilizing and stripping the solvent in the glossy ink using the heater after the ink droplets have landed on the medium, the ink may be increased in viscosity to an appropriate extent. This may avoid bleeding of the ink on the medium and thicken the glossy ink on the medium to a degree of viscosity that allows the pigment particles to move in the glossy ink. By radiating ultraviolet light from the ultraviolet light source after a given waiting time has passed, the ultraviolet-curable resin may be cured to fix the glossy ink to the medium after the pigment particles in the glossy ink have been oriented properly and orderly enough.

In this manner, the degree of orientation of the glossy pigment may be duly improved. This may effectively improve glossiness exerted by a layer formed with the glossy ink (coating film). The ink's stability in terms of its discharge ability and composition and the high glossiness (for example, real metallic texture) may be both successfully achieved.

The glossy ink containing the ultraviolet-curable resin provided by this configuration is not for limited uses with media of certain materials but is applicable to various types of media. Therefore, diversely different printing operations are possible with the glossy ink.

The heater is disposed, for example, at a position opposite the glossy ink head and heats vicinity of ink droplet landing positions on the medium. By using the heater thus positioned, the solvent may be quickly volatilized and stripped after the ink droplets landed on the medium. This may more effectively prevent bleeding of the ink.

The solvent of the ink may be a liquid included in the ink as its main constituent. The solvent being the main constituent of the ink means that the ink contains 30% by weight or more, preferably 50% by weight or more of the solvent. Volatilizing and stripping the solvent in the ink using the heater does not necessarily mean that the solvent is completely volatilized away. It may also mean that the solvent is volatilized away to at least an extent that allows bleeding of the ink to be prevented. The heater volatilizes and strips the solvent in the ink so as to render the ink dots into gelatinous form.

The glossy ink may be a solvent UV ink. The glossy ink in this instance may contain a volatile organic solvent. The glossy ink may be an aqueous ink. The glossy ink in this instance contains water as its solvent. The glossy ink may be a metallic ink. The glossy ink may be an ink containing a pigment in pearl color (pearl pigment).

The pigment particle size refers to the diameter of a pigment particle. The diameter of a pigment particle may be a particle size in design. In practical use, the pigment particle sizes being less than or equal to 0.5 μm may mean that 80% by weight or more (preferably, 90% by weight or more) of the particle sizes of the pigment included in the glossy ink are less than or equal to 0.5 μm.

[Configuration 2]

The glossy ink is a metallic pigment in a form of scaly particles, and the glossy ink is a metallic color ink having metallic luster. Then, when the metallic color ink (metallic ink) is used for printing, the ink's stability in terms of its discharge ability and composition and a real metallic texture may be both successfully achieved.

[Configuration 3]

The solvent included in the glossy ink is a volatile organic solvent. Then, the solvent may be effectively volatilized and stripped in short time by the heater. This may more effectively prevent bleeding of the ink on the medium.

[Configuration 4]

At a time of discharging the droplets of the glossy ink, the glossy ink has a degree of viscosity less than 20 mPa·sec., and the heater volatilizes and strips the solvent in the glossy ink to increase the degree of viscosity of the glossy ink on the medium to greater than or equal to 50 mPa·sec. The glossy ink after the solvent is volatilized away may preferably have a degree of viscosity greater than or equal to 100 mPa·sec., and may more preferably have a degree of viscosity greater than or equal to 1,000 mPa·sec.

By using the glossy ink having very low viscosity when discharged, the ink droplets may be discharged well from the glossy ink head. By volatilizing and stripping the solvent after the glossy ink has landed on the medium, the glossy ink may be increased in viscosity to an extent that bleeding of the ink is avoidable. This may allow the pigment particles in the glossy ink to be oriented well, while preventing bleeding of the ink at the same time.

[Configuration 5]

The printer further includes a main scan driver that prompts the glossy ink head to perform a main scan in which the glossy ink head, while moving in a preset main scanning direction, discharges the droplets of the glossy ink. The glossy ink head performs a preset number of main scans to form dots of the glossy ink at different positions on the medium. The ultraviolet light source irradiates dots of the glossy ink formed in the preset number of main scans with ultraviolet light subsequent to completion of at least a current one of the preset number of main scans.

The mains scans thus performed may appropriately form dots of the glossy ink at different positions on the medium. The ultraviolet light source radiates ultraviolet light, not during each main scan that forms the glossy ink dots, but after completion of the current main scan. This may furnish adequate time for the pigment particles in the glossy ink to be oriented well. In this manner, high glossiness may be effectively attained by the glossy ink in the printer configured to perform main scans.

[Configuration 6]

The waiting time is a preset time that allows the pigment particles in the glossy ink to be orderly oriented on the medium. This may furnish adequate time for the pigment particles in the glossy ink to be oriented well, promising high glossiness of the glossy ink.

[Configuration 7]

A printing method of performing inkjet printing for a medium is provided. The printing method uses a glossy ink head as an inkjet head that discharges droplets of a glossy ink which is an ink with glossiness, a heater that heats the medium, and an ultraviolet light source that irradiates dots of the glossy ink formed on the medium by the glossy ink head with ultraviolet light. The glossy ink includes an ultraviolet-curable resin curable by being irradiated with ultraviolet light, a glossy pigment, and a solvent added to disperse the glossy pigment. Particles of the glossy pigment have particle sizes less than or equal to 0.5 μm. The printing method includes heating the medium using the heater to volatilize and strip the solvent in the glossy ink, and irradiating the dots of the glossy ink on the medium with ultraviolet light emitted from the ultraviolet light source after a preset waiting time has passed subsequent to a timing of the droplets of the glossy ink landing on the medium. This configuration may achieve the same effect as achieved by the configuration 1.

[Configuration 8]

A glossy ink is provided. The glossy ink is for use in a printer that performs inkjet printing for a medium. The glossy ink includes an ultraviolet-curable resin curable by being irradiated with ultraviolet light, a glossy pigment, and a solvent added to disperse the glossy pigment. Particles of the glossy pigment have particle sizes less than or equal to 0.5 μm. In a case that the printer performs the inkjet printing, the solvent is volatilized and stripped by the heater, and dots of the ink formed on the medium are irradiated with ultraviolet light emitted from the ultraviolet light source after a preset waiting time has passed subsequent to a timing of the droplets of the glossy ink landing on the medium.

Effect of the Invention

According to the present invention, the stability and high glossiness of a glossy ink used for printing may be both successfully achieved.

BRIEF DESCRIPTION OF THE DRAWINGS

FIGS. 1A and 1B are front and top views of a main structural unit of the printer 10.

FIG. 2A is a drawing of a structural example of the head unit 12. FIG. 2B is a drawing of a modified structural example of the ultraviolet light source 18.

DESCRIPTION OF EMBODIMENT

Figure 1A:
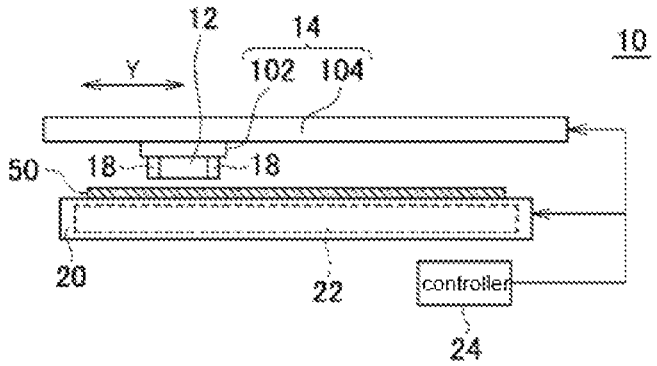
FIGS. 1A and 1B are drawings of a printer 10 according to an embodiment of the present invention.
Figure 1B:
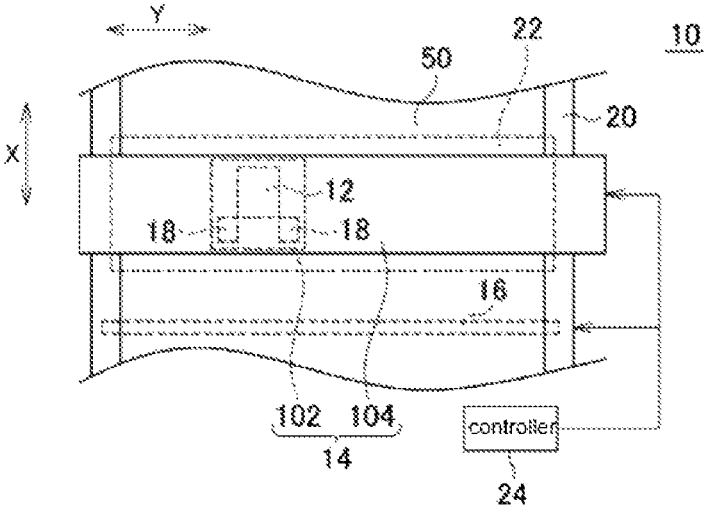

Embodiments of the present invention are hereinafter described referring to the accompanying drawings. FIGS. 1A and 1B are drawings of a printer 10 according to an embodiment of the present invention. FIGS. 1A and 1B are front and top views of a main structural unit of the printer 10. Except for the technical configurations hereinafter described, the printer 10 may be configured identically or similarly to the conventional inkjet printers.

The printer 10 is an inkjet printer that performs inkjet printing for a medium 50 used as a print target. In this embodiment, the printer 10 is a serial inkjet printer that prompts inkjet heads to perform main scans. The printer 10 is equipped with a head unit 12, a main scan driver 14, a sub scan driver 16, ultraviolet light sources 18, a platen 20, a heater 22, and a controller 24.

The head unit 12 is a part that performs printing on the medium 50. As prompted by the controller 24, the head unit 12 forms ink dots on the medium 50 that correspond to respective pixels of an image to be printed. In this embodiment, the head unit 12 has a plurality of inkjet heads that discharge droplets of solvent UV inks. The solvent UV ink contains an ultraviolet-curable monomer or oligomer, and an organic solvent (for example, volatile organic solvent). The solvent UV ink may be an ultraviolet-curable ink diluted with an organic solvent (solvent-diluted UV curable ink). The specifics and operation of the head unit 12 will be described later in further detail.

The main scan driver 14 drives the head unit 12 to perform main scans. The main scan is an operation in which the head unit 12, while moving in a predetermined main scanning direction (Y direction in the figure), discharges ink droplets onto the medium 50. Driving the head unit 12 to perform main scans is specifically driving the inkjet heads of the head unit 12 to perform main scans. In this embodiment, the main scan driver 14 has a carriage 102 and a guide rail 104. The carriage 102 holds the head unit 12 in such a manner that nozzle arrays of the inkjet heads are facing the medium 50. The guide rail 104 guides the carriage 102 to move in the main scanning direction. As prompted by the controller 24, the carriage 102 is moved by the guide rail 104 in the main scanning direction.

The sub scan driver 16 drives the head unit 12 to perform sub scans in which the head unit 12 moves relative to the medium 50 in a sub scanning direction orthogonal to the main scanning direction. Driving the head unit 12 to perform sub scans is specifically driving the inkjet heads of the head unit 12 to perform sub scans. In this embodiment, the sub scan driver 16 is a roller that transports the medium 50. The medium 50 is transported by the sub scan driver 16 at intervals between the main scans, so that sub scans are performed by the head unit 12.

Instead of transporting the medium 50, the printer 10 may be configured to move the head unit 12 relative to the medium 50 being fixed at a position and perform sub scans (for example, X-Y table printer). In this instance, the sub scan driver 16 may be a driver that moves the head unit 12 by moving the guide rail 104 in the sub scanning direction.

The ultraviolet light sources 18 irradiate the ink dots formed on the medium 50 with ultraviolet light. A suitable example of the ultraviolet light source 18 may be UVLED. The positions of the ultraviolet light sources 18 and timings of their operations will be described later in further detail in connection with specifics of the head unit 12.

The platen 20 is a table-like member on which the medium 50 is placed. The platen 20 supports the medium 50 so as to face nozzle-formed surfaces of the inkjet heads of the head unit 12. The heater 22 is provided to heat the medium 50. In this embodiment, the heater 22 is disposed at a position opposite the head unit 12 and heats at least ink droplet landing positions on the medium 50. The organic solvent in the ink is thereby volatilized and striped as soon as the ink droplets land on the medium. This may increase the viscosity of the ink that has just landed on the medium 50, effectively preventing bleeding of the ink. The heating of the medium 50 using the heater 22 will also be described later in further detail in connection with specifics of the head unit 12.

For example, the controller 24 is the CPU of the printer 10 that controls the operations of the structural elements of the printer 10 as prompted by a host PC. The printer 10, characterized by these features, performs printing on the medium 50.

In this embodiment, the medium 50 may be selected from any media made of different materials on which the solvent UV inks is usable. Examples of the medium 50 may include sheets produced from different types of resins. The medium 50 may be a three-dimensional medium having irregularities on a surface on which printing is performed.

Inks containing ultraviolet-curable resins, like the solvent UV ink, are not for limited uses with media 50 of certain materials but are applicable to various types of media 50. A solvent ink, if used instead of the solvent UV ink, may be repelled by the medium 50 depending on its materials used, in which case the printing may not be possible. Solvent inks may be unsuitable for media 50 made of, for example, plastic materials. In this embodiment that uses the solvent UV ink, the printing may be successfully performed even with plastic-made media 50. According to this embodiment, the printing may be performed well with variously different media 50.

Figure 2A:
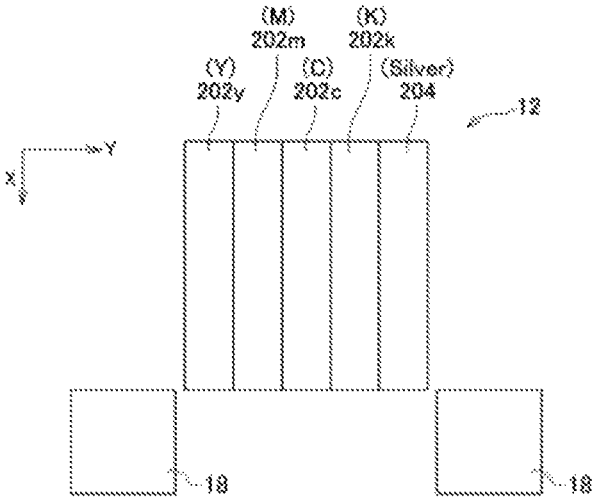
FIGS. 2A and 2B are drawings of a detailed structural example of a head unit 12, illustrated with ultraviolet light sources 18.
Figure 2B:
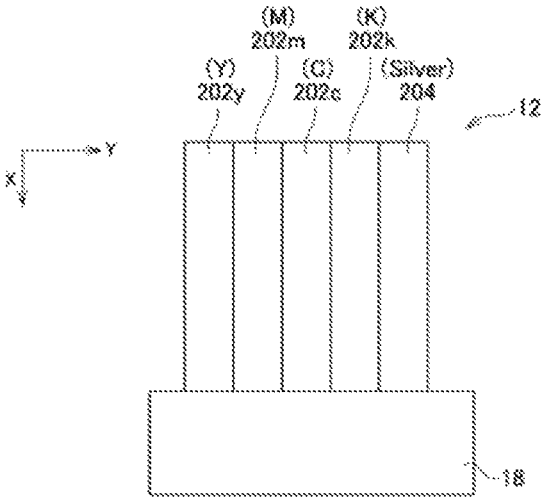

The head unit 12 is now described in detail. FIGS. 2A and 2B are drawings of a detailed structural example of the head unit 12, illustrated with ultraviolet light sources 18. FIG. 2A is a drawing of a structural example of the head unit 12.

In this embodiment, the head unit 12 has a plurality of color printing heads 202*y*, 202*m*, 202*c*, and 202*k* (hereinafter, color printing heads 202*y*-*k*), and a glossy ink head 204. The color printing heads 202*y*-*k* are inkjet heads that respectively discharge droplets of different color inks for color printing. In the illustrated example, the color printing heads 202*y*-*k* respectively discharge droplets of Y (yellow), M (magenta), C (cyan), and K (black) color inks. These color inks may be selected from the known solvent UV inks.

Any suitable ones of the known inkjet heads may be optionally used as the color printing heads 202*y*-*k*. The color printing heads 202*y*-*k* may each have a nozzle array in which a plurality of nozzles are aligned, for example, in the sub scanning direction (X direction). The color printing heads 202*y*-*k* are arranged in the main scanning direction (Y direction) in positional alignment with one another in the sub scanning direction.

The glossy ink head 204 is an inkjet head that discharges droplets of a glossy ink. The glossy ink is used to form a layer constituting a glossy coating film. Any suitable one of the known inkjet heads may be optionally used as the glossy ink head 204. The glossy ink head 204 and the color printing heads 202*y*-*k* may be identically or similarly configured, except for the inks respectively used in these heads.

In this embodiment, the glossy ink may be a solvent UV ink, like the color inks. The glossy ink contains an ultraviolet-curable resin curable by being irradiated with ultraviolet light, a glossy pigment, and a solvent added to disperse the pigment. Particles of the glossy pigment have particle sizes less than or equal to 0.5 μm. The solvent is a volatile organic solvent.

Thus, the pigment having small particle sizes is added to the glossy ink. This may effectively avoid poor ink discharge ability and prevent the pigment from settling out in the glossy ink. Thus, the ink's stability in terms of its discharge ability and composition may be effectively improved. The volatile organic solvent used as the solvent of the glossy ink may be adequately volatilized and stripped in short time by the heater 22 (see FIGS. 1A and 1B).

The pigment particle size refers to the diameter of a pigment particle. The diameter of a pigment particle may be the longitudinal dimension of a pigment particle. The diameter of a pigment particle may be the diameter of a sphere circumscribing the pigment (circumscribed sphere). The diameter of a pigment particle may be a particle size in design. In practical use, the pigment particle sizes being less than or equal to 0.5 μm may mean that 80% by weight or more (preferably, 90% by weight or more) of the particle sizes of the pigment included in the glossy ink are less than or equal to 0.5 μm. With variability of the pigment particle sizes being taken into consideration, the glossy ink may partly include a pigment having particle sizes greater than 0.5 μm unless discharge of the glossy ink through nozzles of the glossy ink head 204 is undermined.

In this embodiment, the glossy ink head 204 discharges droplets of a metallic ink which is an example of the glossy ink. The metallic ink is a metallic color ink having metallic luster. The metallic ink contains a metallic pigment in the form of scaly particles as the glossy pigment.

Specifically, the solvent UV ink used in this embodiment may be a silver color ink, for example. In this instance, the metallic ink contains a pigment in the form of scaly aluminum particles. The metallic ink used in this embodiment may be identical or similar in properties to the known solvent UV inks, except for the pigment added thereto. For example, the metallic ink may contain, as its volatile organic solvent and ultraviolet-curable resin, components identical or similar to the known solvent UV inks. The glossy ink head 204 is disposed adjacent to the color printing heads 202*y*-*k* in the main scanning direction in positional alignment with the color printing heads 202*y*-*k* in the sub scanning direction.

The heating of the medium 50 using the heater 22, and positions of the ultraviolet light sources 18 and timings of their operations are now described in further detail in connection with specifics of the head unit 12. First, the heating of the medium 50 using the heater 22 is described.

As described referring to FIGS. 1A and 1B, the printer 10 in this embodiment (see FIGS. 1A and 1B) has the heater 22 at a position opposite the head unit 12. The heater 22 volatilizes and strips the volatile organic solvent in the ink as soon as the ink droplets land on the medium 50. This may increase the viscosity of the ink on the medium 50, thereby suppressing bleeding of the ink.

In this embodiment, the YMCK color inks and the metallic ink used in the head unit 12, before their volatile organic solvents are volatilized away by the heater 22, have low degrees of viscosity that allow them to be discharged by inkjet technique through nozzles. Specifically, a respective one of the inks may have a degree of viscosity less than 20 mPa·sec at the time of discharging the ink droplets from the color printing heads 202*y*-*k* and the glossy ink head 204.

The heater 22 increases the degree of viscosity by volatilizing and stripping the volatile organic solvent in each ink after the ink droplets have landed on the medium 50. To be specific, the heater 22 increases the degree of viscosity of the ink on the medium 50 to greater than or equal to 50 mPa·sec. The inks, after their volatile organic solvents are volatilized away, may preferably have degrees of viscosity greater than or equal to 100 mPa·sec., and may more preferably have degrees of viscosity greater than or equal to 1,000 mPa·sec.

Preferably, the metallic ink dot formed by the glossy ink head 204, after the volatile organic solvent is volatilized away may have a degree of viscosity that allows the pigment particles to move in the ink and to be oriented well.

By using the inks having very low degrees of viscosity when discharged, the ink droplets may be duly discharged from the color printing heads 202*y-k* and the glossy ink head 204. By volatilizing and stripping the volatile organic solvent after each ink has landed on the medium 50, the ink may be increased in viscosity to an extent that bleeding of the ink is avoidable. This may effectively suppress bleeding of the ink.

The ink bleeding means color smearing when low-viscosity dots of different color inks contact and bleed into one another. Specifically, ink bleeding as to the metallic ink may be one that occurs on and around an interface between a region painted over with the metallic ink and its peripheral region. In case a metallic-tinged print result is obtained by performing printing on the same region with color and metallic inks, for example, the YMCK color inks and the metallic ink possibly bleed into one another in the region.

The positions of the ultraviolet light sources 18 and timings of their operations are now described. In this embodiment, the ultraviolet light sources 18 are disposed at positions displaced in the sub scanning direction from the color printing heads 202*y-k* and the glossy ink head 204. The ultraviolet light sources 18 thus located irradiate the ink dots formed on the medium 50 with ultraviolet light after a preset waiting time has passed subsequent to timings of the YMCK color inks and the metallic ink landing on the medium 50.

Specifically, the printer 10 in this embodiment has a plurality of ultraviolet light sources 18. In this embodiment, a respective one of the ultraviolet light sources 18, with their positions being displaced in the sub scanning direction from the color printing heads 202*y-k* and the glossy ink head 204, is disposed on one side and the other side of the alignment of these heads in the main scanning direction. The ultraviolet light sources 18 are displaced in the sub scanning direction, so that they are located further downstream than the color printing heads 202*y-k* and the glossy ink head 204 in a direction in which the medium 50 is transported.

At different positions on the medium 50, the color printing heads 202*y-k* and the glossy ink head 204 form the respective color ink dots by performing a preset number of main scans. In each main scan, the ultraviolet light sources 18 are moved over a region on the medium that differs from a region where the ink dots are formed in the main scan by the color printing heads 202*y-k* and the glossy ink head 204. Thus, the ink dots formed in a current one of the main scans is not irradiated with ultraviolet light emitted from the ultraviolet light sources 18 during the current main scan.

The sub scan driver 16 (see FIGS. 1A and 1B) transports the medium 50 for sub scans to be performed after a respective one of the preset number of main scans. Then, the color printing heads 202*y-k*, glossy ink head 204, and ultraviolet light sources 18 sequentially face different regions on the medium 50. The ultraviolet light sources 18 irradiate the ink dots formed on the medium 50 in each of the main scans with ultraviolet light at a timing of a subsequent one of the main scans being performed. Thus, the ultraviolet light sources 18 cure the ink dots when a time equal to or longer than the given waiting time passes after the ink droplets have landed on the medium 50.

By performing mains scans and sub scans at intervals between the main scans repeatedly, the ink dots may be appropriately formed at different positions on the medium 50. The ultraviolet light sources 18 radiate ultraviolet light, not during each main scan that forms the ink dots, but after completion of the current main scan. This may furnish adequately long time before the inks start to be cured. By suitably adjusting positions of the ultraviolet light sources 18, the time to ultraviolet radiation after the formation of the ink dots on the medium 50 may be optionally changed.

This may allow the different color ink dots to be adequately flattened (leveled out), succeeding in obtaining a glossy printed matter improved in smoothness and glossiness.

The metallic ink droplets are irradiated with ultraviolet light after a certain period of time passes instead of immediately after they have landed on the medium. In this manner, the ink curing time may be well-controlled, and plenty of time may be furnished for the pigment particles in the ink to be orderly oriented. This may prevent that the metallic ink is fixed to the medium 50 with the pigment particles being randomly oriented, and may also improve glossiness exerted by a layer formed with the metallic ink (coating film). According to this embodiment, the metallic ink may be fixed to the medium 50 with a real metallic texture and brightness.

In this embodiment, the volatile organic solvent in the ink is volatilized and stripped by the heater 22 so as to increase the ink in viscosity to an extent that bleeding of the ink is avoidable immediately after the ink droplets have landed on the medium. This may effectively avoid bleeding of the ink even when the time to radiation of ultraviolet light is prolonged. In this instance, even when a metallic ink is used that contains a pigment having such small particle sizes as 0.5 μm or less, for example, plenty of time may be invested for the pigment particles to be oriented well, and the metallic ink may be fixed to the medium 50 with a real metallic texture.

By using the solvent UV inks as described so far, bleeding of the inks may be suppressed, and plenty of time may be provided for the ink dots to be flattened. Even when a metallic ink containing a pigment having small-sized particles is used, the two operations; volatilizing and stripping the solvent (volatile organic solvent) in the ink using the heater 22, and irradiating the ink with ultraviolet light using the ultraviolet light sources 18, may prevent bleeding of the ink and allow the pigment particles to be oriented properly and orderly enough, successfully obtaining a print result with a real metallic texture. By using a pigment having small-sized particles in the metallic ink, the metallic ink's stability in terms of its discharge ability and composition may be duly improved. Thus, this embodiment may achieve both of the ink's stability and a real metallic texture.

The time to radiation of ultraviolet light after the ink droplets have landed on the medium depends on a relationship in position among the color printing heads 202*y-k*, glossy ink head 204, and ultraviolet light sources 18, specifics of the printer 10 such as the moving speed of the head unit 12 during main scans, and printing conditions. Therefore, these factors and conditions may preferably be optionally decided in accordance with inks used for printing. Specifically, a minimum waiting time before ultraviolet radiation starts after the ink droplets have landed on the medium may preferably be long enough for the pigment particles of the metallic ink to be oriented well on the medium 50. This may furnish adequate time for the pigment particles in the metallic ink to be oriented well, achieving a real metallic texture using the metallic ink.

A modified embodiment of the printer 10 is hereinafter described. In the printer 10 according to the modified embodiment, arrangements of the color printing heads

202*y-k* and the glossy ink head 204 in the head unit 12, and configurations of the ultraviolet light sources 18 may be variously changed. FIG. 2B is a drawing of a modified structural example of the ultraviolet light source 18. Except for the technical configurations hereinafter described, the structural elements illustrated in FIGS. 2A and 2B with the same reference signs are identically or similarly configured.

In the earlier embodiment, a respective one of the ultraviolet light sources 18, with their positions being displaced in the sub scanning direction from the color printing heads 202*y-k* and the glossy ink head 204, is disposed on one side and the other side of the alignment of these heads in the main scanning direction, as illustrated in FIG. 2A. In the printer 10 according to the modified embodiment, however, one ultraviolet light source 18 may be disposed at a position displaced in the sub scanning direction from the color printing heads 202*y-k* and the glossy ink head 204, as illustrated in FIG. 2B.

This modified embodiment may allow the metallic ink containing small-sized pigment particles to be oriented properly and orderly enough, while preventing bleeding of the ink in a manner identical or similar to the printer described referring to FIG. 2A. According to this modified embodiment, therefore, a print result with a real metallic texture may be obtained. By using a pigment having small-sized particles in the metallic ink, the metallic ink's stability in terms of its discharge ability and composition may be duly improved. Thus, this embodiment may achieve both of the ink's stability and a real metallic texture.

For illustrative purposes, the color printing heads 202*y-k*, glossy ink head 204, and ultraviolet light source 18 in FIGS. 2A and 2B are not illustrated to scale. The sizes of these structural elements in the printer 10 for practical use may be optionally decided depending on printing conditions.

Specifically, for example, the length of the ultraviolet light source 18 in the sub scanning direction may be commensurate with the width of a printing pass. The width of a printing pass refers to a width of one printing pass region in the sub scanning direction in multi-pass printing. The length of the ultraviolet light source 18 in the sub scanning direction may preferably be at least greater than the width of a printing pass.

The ultraviolet light sources 18 may be arranged in the main scanning direction in positional alignment with the color printing heads 202*y-k* and the glossy ink head 204 in the sub scanning direction, in which case the color printing heads 202*y-k* and the glossy ink head 204 may be interposed between the ultraviolet light sources 18 in the main scanning direction. In this instance, additional scans may be performed at different positions on the medium 50 in order to irradiate the ink dots formed in the main scans with ultraviolet light emitted from the ultraviolet light sources 18. During the additional scans for ultraviolet radiation, the color printing heads 202*y-k* and the glossy ink head 204 may move with the ultraviolet light sources 18 in the main scanning direction without the inks being discharged form these heads.

The printer 10 may be further provided with an additional ultraviolet light source at a position other than the positions illustrated in FIGS. 2A and 2B. The additional ultraviolet light source may be disposed at a position adjacent to the color printing heads 202*y-k* and the glossy ink head 204 in the main scanning direction in positional alignment with these heads in the sub scanning direction. For example, the additional ultraviolet light source, if necessary, may radiate ultraviolet light during the main scans depending on a printing operation mode currently set. Specifically, in case of matte printing using the color printing heads 202*y-k*, for example, the ink dots may be cured by the additional ultraviolet light source, or the additional ultraviolet light source may be configured to radiate ultraviolet light weak enough to avoid full cure of the ink dots in each of the main scans.

The positions of the color printing heads 202*y-k* and the glossy ink head 204 may be variously changed. The glossy ink head 204 may be disposed at a position displaced in the sub scanning direction from the color printing heads 202*y-k*.

In the description so far, the metallic ink is used as the glossy ink. Instead of the metallic ink, the glossy ink used may be selected from other glossy inks. A specific example of the glossy ink may be an ink containing a pigment in pearl color (pearl pigment). Similarly to the metallic ink, such an ink may contain small-sized pigment particles, and the pigment particles in the ink may be oriented properly and orderly enough, while bleeding of the ink may be suppressed at the same time. As a result, the ink's stability may be improved, and a print result that excels in glossiness may be obtained.

In the description so far, the glossy ink used in the head unit 12 (metallic ink) is the solvent UV ink. The solvent UV ink is an example of hybrid inks fixable to the medium 50 by the two operations; heating by the heater 22, and ultraviolet radiation from the ultraviolet light sources 18. Such a hybrid ink used in the printer 10 of the modified embodiment is not necessarily limited to the solvent UV ink but may be an aqueous ink containing water as its main constituent. It is meant by water being the main constituent that the ink contains 30% by weight or more, preferably 50% by weight or more of water. In this instance, the glossy ink contains an ultraviolet-curable resin curable by being irradiated with ultraviolet light, a glossy pigment, and water added to disperse the pigment. In this composition, water serves as the solvent of the ink.

Also when such a glossy ink is used, bleeding of the ink may be prevented by volatilizing and striping the solvent in the ink using the heater 22. With a long-time interval before the ultraviolet light sources 18 start to radiate ultraviolet light, plenty of time may be invested for the pigment particles in the glossy ink to be oriented, while bleeding of the ink may be suppressed at the same time. Therefore, similarly, such an ink may contain small-sized pigment particles, and the pigment particles may be oriented properly and orderly enough, while bleeding of the ink may be suppressed at the same time. As a result, the ink's stability may be improved, and a print result that excels in glossiness may be obtained.

The present invention was thus far described in connection with the embodiments; however, the scope of the present invention is not necessarily limited to the technical configurations disclosed herein. It is obvious to those skilled in the art that various modifications and/or improvements may be made. The technical scope of the present invention encompasses any of such modifications and/or improvements as is clearly known from the appended claims.

INDUSTRIAL APPLICABILITY

The present invention is suitably applicable to printers.

The invention claimed is:

1. A printer that performs inkjet printing for a medium, comprising:

a glossy ink head as an inkjet head that discharges droplets of a glossy ink which is an ink with glossiness;

a heater that heats the medium; and an ultraviolet light source that irradiates dots of the glossy ink formed on the medium by the glossy ink head with ultraviolet light, wherein the glossy ink including: an ultraviolet-curable resin curable by being irradiated with ultraviolet light, a glossy pigment, and a solvent added to disperse the glossy pigment, particles of the glossy pigment having particle sizes less than or equal to 0.5 μm, the heater heating the medium to volatilize and strip the solvent in the glossy ink, and the ultraviolet light source irradiating the dots of the glossy ink on the medium with ultraviolet light after a preset waiting time has passed subsequent to a timing of the droplets of the glossy ink landing on the medium;

wherein the glossy pigment is a metallic pigment in a form of scaly particles, and the glossy ink is a metallic color ink having metallic luster;

wherein the solvent included in the glossy ink is a volatile organic solvent, and the volatile organic solvent has an amount of 30% by weight or more of the glossy ink;

wherein at a time of discharging the droplets of the glossy ink, the glossy ink has a degree of viscosity less than 20 mPa·sec, and the heater volatilizes and strips the solvent in the glossy ink to increase the degree of viscosity of the glossy ink on the medium to greater than or equal to 1000 mPa·sec.

2. The printer as set forth in claim 1, further comprising:

a main scan driver that prompts the glossy ink head to perform a main scan in which the glossy ink head, while moving in a preset main scanning direction, discharges the droplets of the glossy ink, wherein the glossy ink head performs a preset number of the main scan to form dots of the glossy ink at different positions on the medium, and the ultraviolet light source irradiates dots of the glossy ink formed in the preset number of main scan with ultraviolet light subsequent to completion of at least a current one of the preset number of main scan.

3. The printer as set forth in claim 1, wherein the waiting time is a preset time that allows the particles of the glossy pigment in the glossy ink to be orderly oriented on the medium.

4. A printing method of performing inkjet printing for a medium, the printing method using:

a glossy ink head as an inkjet head that discharges droplets of a glossy ink which is an ink with glossiness;

a heater that heats the medium; and an ultraviolet light source that irradiates dots of the glossy ink formed on the medium by the glossy ink head with ultraviolet light, wherein the glossy ink including: an ultraviolet-curable resin curable by being irradiated with ultraviolet light, a glossy pigment, and a solvent added to disperse the glossy pigment, particles of the glossy pigment having particle sizes less than or equal to 0.5 μm, the printing method comprising:

heating the medium using the heater to volatilize and strip the solvent in the glossy ink; and irradiating the dots of the glossy ink on the medium with ultraviolet light emitted from the ultraviolet light source after a preset waiting time has passed subsequent to a timing of the droplets of the glossy ink landing on the medium;

wherein the glossy pigment is a metallic pigment in a form of scaly particles, and the glossy ink is a metallic color ink having metallic luster;

wherein the solvent included in the glossy ink is a volatile organic solvent, and the volatile organic solvent has an amount of 30% by weight or more of the glossy ink;

wherein at a time of discharging the droplets of the glossy ink, the glossy ink has a degree of viscosity less than 20 mPa·sec, and the heater volatilizes and strips the solvent in the glossy ink to increase the degree of viscosity of the glossy ink on the medium to greater than or equal to 1000 mPa·sec.

5. A glossy ink for use in a printer that performs inkjet printing for a medium, comprising:

an ultraviolet-curable resin curable by being irradiated with ultraviolet light;

a glossy pigment; and a solvent added to disperse the glossy pigment, wherein particles of the glossy pigment having particle sizes less than or equal to 0.5 μm, in a case that the printer performs the inkjet printing, the solvent being volatilized and stripped by the heater, dots of the glossy ink formed on the medium being irradiated with ultraviolet light emitted from the ultraviolet light source after a preset waiting time has passed subsequent to a timing of the droplets of the glossy ink landing on the medium;

wherein the glossy pigment is a metallic pigment in a form of scaly particles, and the glossy ink is a metallic color ink having metallic luster;

wherein the solvent included in the glossy ink is a volatile organic solvent, and the volatile organic solvent has an amount of 30% by weight or more of the glossy ink;

wherein at a time of discharging the droplets of the glossy ink, the glossy ink has a degree of viscosity less than 20 mPa·sec, and the heater volatilizes and strips the solvent in the glossy ink to increase the degree of viscosity of the glossy ink on the medium to greater than or equal to 1000 mPa·sec.

* * * * *